United States Patent [19]

Paige

[11] 4,406,380

[45] * Sep. 27, 1983

[54] COLLAPSIBLE CARTON

[75] Inventor: Richard E. Paige, New York, N.Y.

[73] Assignee: The Paige Company Containers, Inc., New York, N.Y.

[ * ] Notice: The portion of the term of this patent subsequent to Apr. 20, 1999 has been disclaimed.

[21] Appl. No.: 344,454

[22] Filed: Feb. 1, 1982

Related U.S. Application Data

[63] Continuation-in-part of Ser. No. 137,655, Apr. 7, 1980, Pat. No. 4,325,493.

[51] Int. Cl.[3] ..... B65D 5/02; B65D 5/36; B65D 5/56

[52] U.S. Cl. ..... 220/416; 229/37 R; 229/41 B

[58] Field of Search ..... 220/416, 418; 229/41 B, 229/37 R, 23 R, 31 R

[56] References Cited

U.S. PATENT DOCUMENTS

| | | | |
|---|---|---|---|
| 2,312,644 | 3/1943 | Horr | 229/31 R |
| 2,577,588 | 12/1951 | Paige | 229/41 B |
| 2,764,335 | 9/1956 | Kleingers | 229/31 R |
| 2,843,308 | 7/1958 | Paige | 229/41 B |
| 3,278,108 | 10/1966 | Paige | 229/37 R |
| 3,281,050 | 10/1966 | Suchodolski | 229/37 R |
| 3,430,840 | 3/1969 | Paige | 229/37 R |
| 3,960,312 | 6/1976 | Gorham | 229/37 R |
| 4,087,041 | 5/1978 | Centanni | 229/37 R X |
| 4,325,493 | 4/1982 | Paige | 220/416 |

FOREIGN PATENT DOCUMENTS

| | | | |
|---|---|---|---|
| 658389 | 10/1951 | United Kingdom | 229/41 B |

*Primary Examiner*—Allan N. Shoap
*Attorney, Agent, or Firm*—Alan H. Levine

[57] ABSTRACT

A collapsible carton comprising inner and outer snugly nestable tubular shells. Each shell includes a series of side wall panels hingedly connected together along their side edges. The shells are telescopically adjustable into and out of a set-up relationship in which the overlying side wall panels define a set of double-walled carton sides. A plurality of foldable strips interconnect adjacent bottom edges of the overlying side wall panels, the strips being unfolded and parallel to their respective side wall panels when the inner shell is pulled out of the outer shell to its maximum extent, and the strips being folded and extending transverse to the side wall panels when the shells are telescoped into set-up relationship so as to define the carton floor. The side edges of adjacent side wall panels of the inner shell are severed from each other, and preferably separated by a gap, at their lower ends, so as to permit the lower end of the inner shell to constrict as the inner shell is telescoped into the outer shell. The length of the gap must be at least twice its width, and the length of the gap must be between one-sixth to one-half the height of the carton. Each hinge connection between the side wall panels of the inner shell may be formed by a pair of parallel hinge lines, and the gap between the adjacent side wall panels may be between the pair of hinge lines.

7 Claims, 6 Drawing Figures

FIG. 1
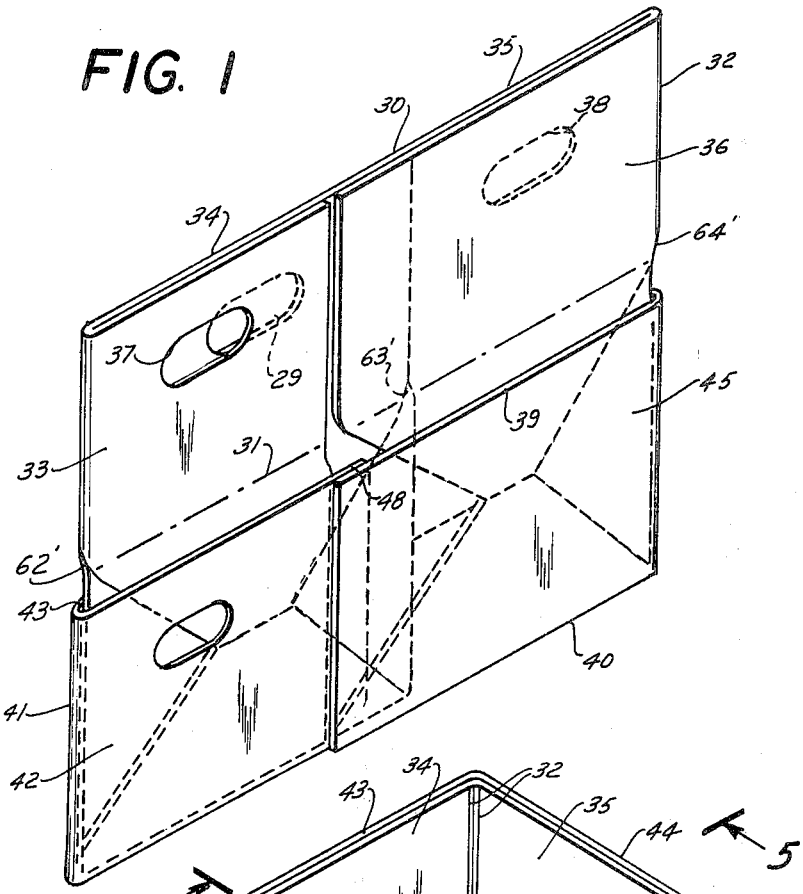
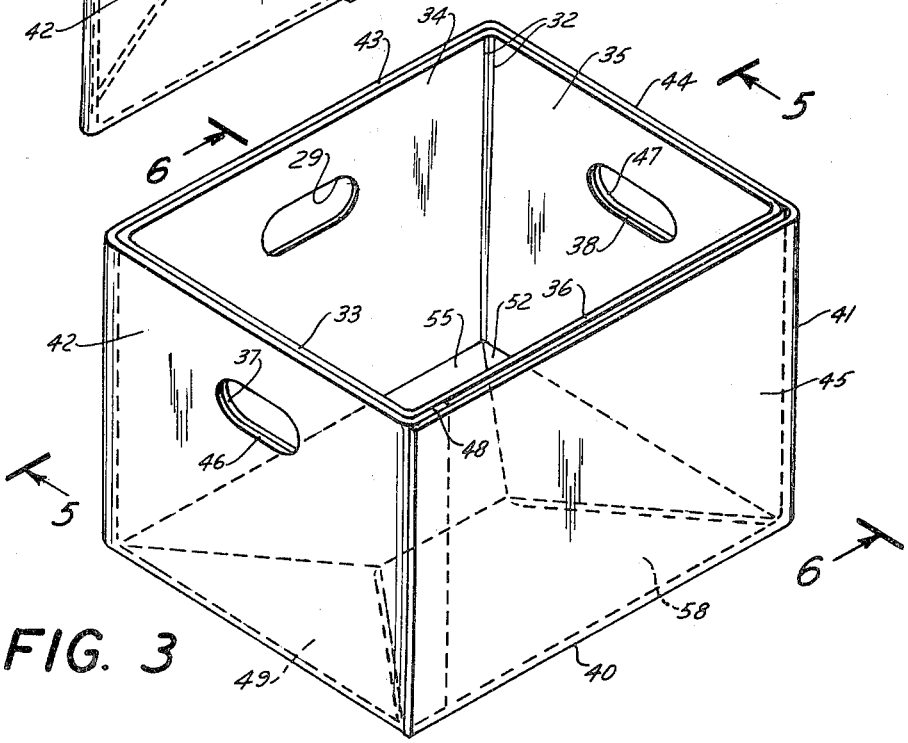
FIG. 3

COLLAPSIBLE CARTON

This application is a continuation-in-part of copending application Ser. No. 137,655, filed Apr. 7, 1980, now U.S. Pat. No. 4,325,493, issued Apr. 20, 1982.

This invention relates to collapsible cartons of the type which are usually formed of corrugated cardboard, and particularly to such cartons having double-walled sides. More specifically, the invention involves an improvement in cartons of the type shown and described in U.S. Pat. No. 2,577,588.

In these cartons, inner and outer tubular shells are snugly nested, the shells being telescopically extended when the carton is collapsed flat for shipping and storage, and the inner shell being moved telescopically into the outer shell, when the carton is set up for use, to define a series of double-walled carton sides. A foldable strip is hinged to the bottom edges of the overlying walls of each carton side, these strips being extended generally in the plane of the flattened shells when the carton is collapsed flat. When the carton is set up, the strips fold and assume a position transverse to the carton sides to define a multiple layer bottom of the carton.

A problem presented by this known carton construction involves the fact that the inner and outer shells have substantially the same dimensions; the only reason that the inner shell can be nested within the outer shell is that the corrugated cardboard has air spaces within it permitting the side wall panels of the inner shell to be crushed in the direction of their thickness. Once nested, the shells are so tightly fitted together that separating the shells to collapse the carton is an extremely difficult job.

Several attempts have been made to solve this problem, but at best they have been only moderately successufl. The problem was recognized in U.S. Pat. No. 2,577,588, and was dealt with in the embodiment illustrated in FIGS. 16–18 of that patent. The carton blank was cut between the two central side wall panels of the inner shell to remove a strip of material and leave a gap between the panels. As a result, in the assembled structure, the inner shell is a little smaller than the outer shell. This approach involves the disadvantage that the inner shell is actually two separate pieces, and hence the set-up carton is less sturdy than one in which both shells are one-piece structures. Furthermore, the blank itself is less rigid, and hence more difficult to handle by automatic box-forming machinery.

In U.S. Pat. No. 3,430,840, the problem was dealt with by cutting and scoring the blank in such a way that the inner and outer shells are tapered. The difficulty presented by this approach is that when the carton is set up, the walls are not perpendicular to the carton floor.

Another feature which has helped, but not solved, the problem is the provision of a hand opening in the inner panel of one of the carton side walls, which is grasped in order to pull the inner shell out of the outer shell. Preferably, this feature is employed in a carton according to the present invention as well.

It is an object of the present invention to provide a carton of the type described above wherein the inner and outer tubular shells, which define the carton sides, can be telescoped into and out of nesting relationship relatively easily, but without employing the disadvantageous expedients outlined above.

It is a more specific object of the invention to provide such a carton wherein the portion of the inner shell which first enters the outer shell, when the shells are being nested, is able to constrict during the initial nesting movement. As a result, the constricted portion of the inner shell is not only smaller than the outer shell, thereby easing the nesting procedure, but this portion guides the remainder of the inner shell smoothly into the outer shell.

Additional objects and advantages of the invention will be apparent from the following description in which reference is made to the accompanying drawings.

In the drawings:

FIG. 1 is a perspective view of a carton in accordance with this invention in flattened or collapsed condition;

FIG. 3 is a perspective view of the carton in completely set-up condition;

Figure 4:
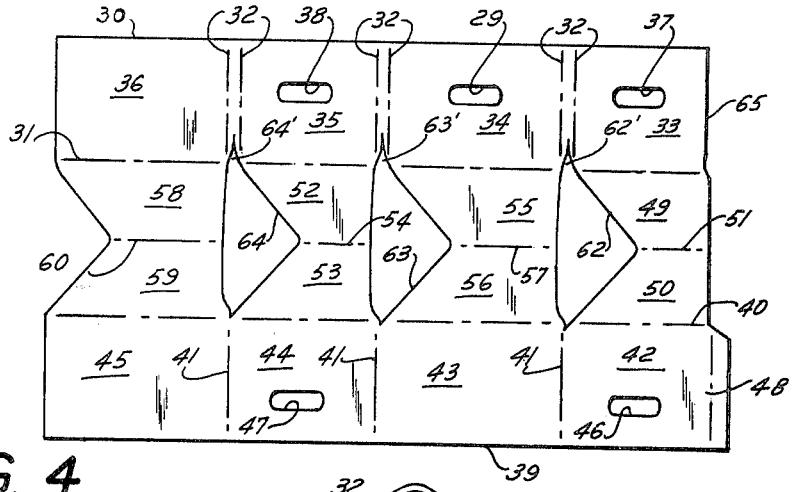
FIG. 4 is a pattern view of a single blank of which the carton may be formed.
Figure 2:
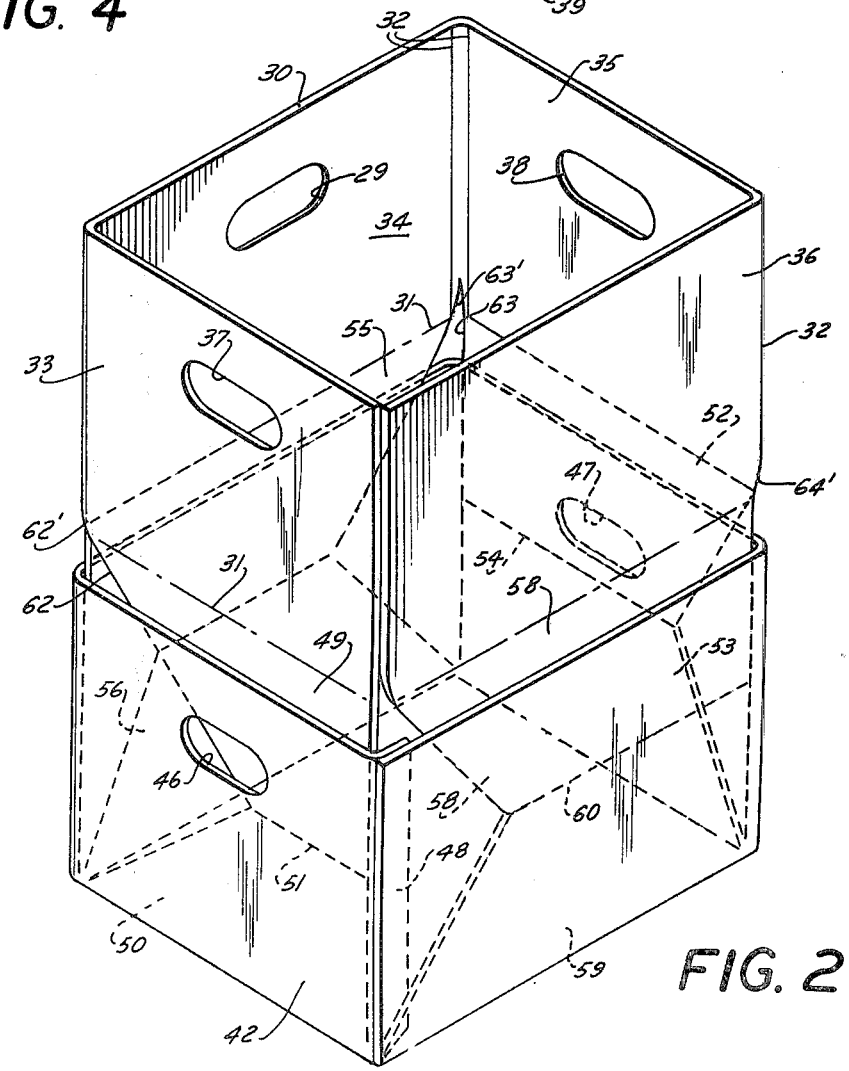
FIG. 2 is a perspective view of the carton in partially set-up condition.

Referring first to FIG. 4, a substantially rectangular carton of the present improved character may be formed of a single substantially rectangular blank of foldable sheet material which is scored and cut as indicated. Parallel to the edge 30 is a score line 31. This line, in conjunction with pairs of transverse score lines 32, defines a series of four rectangularpanels 33, 34, 35 and 36 which are ultimately in hinged relationship along the lines 32 to define the four sides of a tubular shell of substantially rectangular cross section when set up. It will be observed that the panels 33 and 35 are substantially the same in size, and the panels 34 and 36 are substantially the same in size. For a purpose hereinafter to be described, the panel 33 is provided with an opening 37, the panel 35 is provided with a similar opening 38, and the panel 34 is provided with an opening 29.

The panels 33–36 are adapted ultimately to form the four sides of an inner tubular shell adapted to nest within an outer shell hereinafter to be referred to.

Parallel to the opposite edge 39 of the blank is a score line 40 which, in conjunction with transverse score lines 41, each of which generally aligns with one of the pairs of lines 32, defines a second series of substantially rectangular panels 42, 43, 44 and 45. The panels 42 and 44 are substantially equal in size, and the panels 43 and 45 are substantially equal in size. The panel 42 is provided with the opening 46, and the panel 44 is provided with the similar opening 47.

The panels 42–45 are adapted ultimately to form the four sides of the outer tubular shell hereinbefore mentioned.

Between the score lines 31 and 40, the blank is cut and scored to define a series of adjacent connecting strips ultimately adapted to serve as foldable sections which cooperate to form the carton floor support. One connecting strip consists of the sections 49 and 50 mutually hinged along the line 51. The sections 49 and 50 are generally trapezoidal in shape, the long base of the trapezoid 49 coinciding with the adjacent long edge of the panel 33 and the long base of trapezoid 50 coinciding with the adjacent long edge of the panel 42. A similar set of sections 52 and 53 are formed between the panels 35 and 44, the sections 52 and 53 being mutually hinged along the line of fold 54. The connecting strip between the panels 36 and 45 consists of larger trapezoidal sections 58 and 59 mutually hinged at 60, and a similar strip consisting of sections 55 and 56, hinged together at 57, in interposed between panels 34 and 43.

The trapezoidal shapes of the connecting strip sections are defined in part by three generally triangular openings in the blank. Opening 62, between strip 49, 50 and strip 55, 56, has a corner 62' projecting beyond score line 31 into the region between the score lines 32 which are located between panels 33 and 34. As a result, the lower ends of panels 33 and 34 are severed from each other and actually separated by a gap. Similarly, opening 63 has a corner 63' projecting above score line 31 to provide a gap between the lower ends of panels 34 and 35, and opening 64 has a corner 64' projecting above score line 31 to provide a gap between the lower ends of panels 35 and 36. In addition, preferably the width of panel 33 is reduced by shaving its free side edge 65, as indicated in FIG. 1.

The reason for providing gaps between the lower ends of the inner shell panels, and for narrowing panel 33, will be indicated below. However, it should be noted here that to achieve the goal of the present invention, the length of each gap 62', 63', and 64', i.e., its vertical dimension in FIG. 4, should be at least twice its width, and preferably three times its width. The width dimension referred to is the horizontal dimension, in FIG. 1, at the lower end of the gap, i.e., the point at which the gap intersects score line 31. Furthermore, the ratio of the length of each gap 62', 63' and 64' to the height of the inner tubular shell 33–36 should be between 1:6 and 1:2. The height of the shell is, of course, the distance between score line 31 and edge 30.

After the blank has been scored and cut as indicated in FIG. 4 and as herein described, it is folded upon itself along the line 40, and is then folded transversely along the lines 32 and 41 at each side until the attachment flap 48 (on the end of panel 42) is brought into overlapping engagement with the free edge of the panel 45. This flap is then secured to this free edge either by gluing, stapling, or otherwise, and the resultant structure assumes the flattened condition shown in FIG. 1. This completes the manufacturing procedure, which, is will be noted, is extremely simple and inexpensive. In the condition shown in FIG. 1, the device may be stacked with others, packaged, readily transported, or stored.

The process of setting up the device is illustrated most clearly in FIGS. 2, 3, 5 and 6. The first step is to open the device into the condition shown in FIG. 2, in which each shell assumes a substantially tubular configuration. The outer shell, as hereinbefore mentioned, consists of the panels 42–45, its lower edge being defined by the line 40. The inner shell consists of the panels 33–36, its lower edge being defined by the line 31. Connecting these lower edges are the scored foldable strips, which, in FIGS. 1 and 2, lie substantially parallel to the respective panels which they connect.

Figure 5:
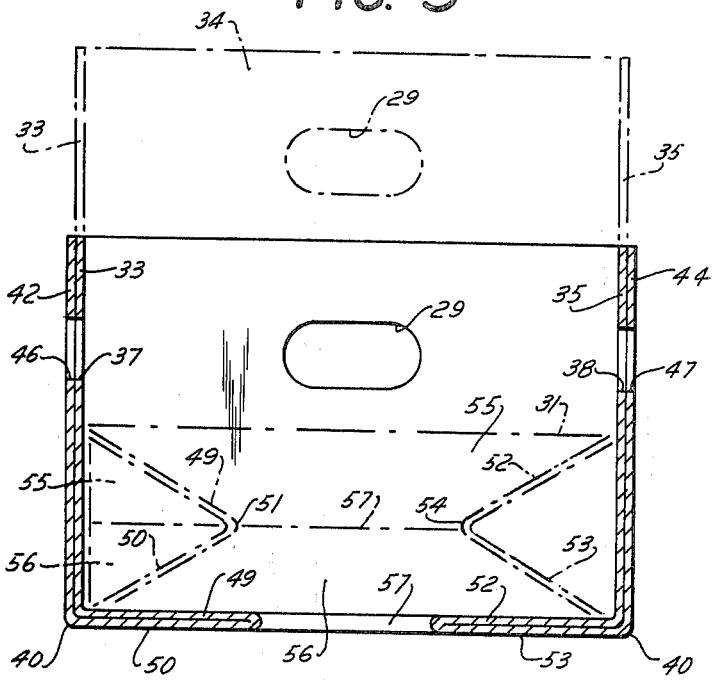
FIG. 5 is a vertical cross-sectional view taken along line 5—5 of FIG. 3.
Figure 6:
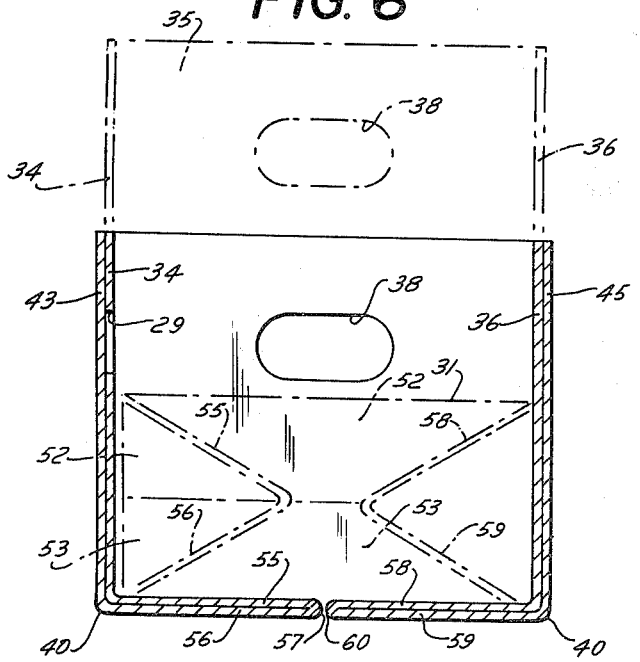
FIG. 6 is a vertical cross-sectional view taken along line 6—6 of FIG. 3.

The next and final step in setting up the structure is illustrated most clearly in FIGS. 5 and 6, and consists in pressing the inner shell into the outer shell, i.e., by adjusting the shells into telescopically contracted relation. During this movement, the connecting strips angle inwardly, i.e., each strip folds upon itself. During this folding adjustment, the sections 49–50 slide between the folds of the trapezoidal sections 58 and 59, sections 58–59 in turn slide between the folds of sections 52 and 53, at the same time sections 52–53 slide between the folds of sections 55 and 56, and sections 55–56, slide between the folds of sections 49 and 50. Ultimately, the four folded sections lie in the interengaged relationship shown most clearly in FIGS. 3, 5, and 6. In this condition, these sections conjointly define a multi-walled carton floor.

During the initial movement of the inner shell into the outer shell, the gaps 62', 63', and 64' between the lower ends of the inner shell panels 33–34, 34–35, and 35–36, permit the lower ends of the inner shell side walls to bend inwardly toward each other to close the spaces between their edges. As a result, the cross-sectional dimensions of the inner shell are reduced, and this constriction permits the inner shell to slide easily into the outer shell. Constriction of the inner shell is also aided by the fact that panel 33 has been reduced in width. As movement of the inner shell into the outer shell continues, the entire inner shell constricts progressively in the direction of its height because the region between each pair of score lines 32 is squeezed inwardly. This results in the score lines 32 of each pair moving closer to each other, thereby effectively reducing the size of the inner shell. The fact that the lower ends of each pair of score lines 32 are separated from each other permits the inner shell to initially easily enter the outer shell, and aids in the orderly progressive constriction of the inner shell during its movement into the outer shell.

It has been found that the length of each gap 62', 63' and 64' must be at least twice its width (at the intersection with score line 31), and the length of each gap must be at least one-sixth the height of the inner shell, in order for the separations between the lower ends of the inner shell panels to be effective. Actually, the longer the gap, the better; however, if the length of the gap exceeds one-half the height of the inner shell, the interconnections between the inner shell panels 33–36 are unduly weakened, making the carton blank more difficult to handle and the set-up carton less sturdy. If the gap is not made as long as indicated above, and preferably three times as long as its width, it does not aid in inserting the inner shell into the outer shell since there is no smooth initiation of a constriction of the inner shell. In addition, without the gap as described above, it is extremely difficult or impossible to separate the inner and outer shells when it is desired to collapse the carton.

Upon completion of the setting-up operation there will be a registry of the openings 37 and 46 in one of the side walls of the carton, and a corresponding registry of the openings 38 and 47 in the opposite side wall. Each pair of registering openings affords a convenient hand grip by means of which the carton may be conveniently grasped for lifting it or transporting it from place to place. Furthermore, opening 29 in inner panel 34 may be used when reversing the operation described above, to collapse the carton. Opening 29 is grasped by one hand while the other applies force to the upper edge of panel 43, and the inner shell is lifted out of the outer shell. Then, the carton may be folded flat to the condition of FIG. 2.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A carton comprising inner and outer snugly nestable tubular shells, each shell including a series of side wall panels hingedly connected together along their side edges, said shells being telescopically adjustable into and out of a set-up relationship in which the overlying side wall panels define a set of double-walled carton sides, a plurality of foldable strips hingedly interconnecting adjacent bottom edges of said overlying side wall panels, said strips being unfolded and parallel to their respective side wall panels when said inner shell is pulled out of said outer shell to its maximum extent and said strips being folded and extending transverse to said side wall panels when said shells are telescoped into the set-up relationship as to define the carton floor, the side edges of adjacent side wall panels of said inner shell being severed from each other at their lower ends so as to permit the lower end of said inner shell to constrict as the inner shell is telescoped into the outer shell, the severance having a length to width ratio of at least 2:1, and the length of the severance being related to the height of the inner shell by a ratio of at least 1:6.

2. A carton as defined in claim 1 wherein the severance has a length to width ratio of at least 3:1, and the length of the severance being related to the height of the inner shell by a ratio of between 1:6 and 1:2.

3. A carton as defined in claim 1 wherein the lower ends of the side edges of adjacent side walls of said inner shell are spaced apart when said inner shell is out of said outer shell to its maximum extent, the lower ends of the inner shell side walls being bent inwardly toward each other to close the spaces between their edges and reduce the cross-sectional dimenisons of the inner shell as the inner shell is telescoped into the outer wall.

4. A carton as defined in claim 3 wherein each hinge connection between the side wall panels of said inner shell is formed by a pair of parallel hinge lines, the spacing between the inner shell side walls being between said pair of hinge lines.

5. A carton as defined in claim 1 including an opening between the side edges of adjacent foldable strips when said inner shell is pulled out of said outer shell to its maximum extent, said opening extending into the region between the side edges of adjacent side wall panels of said inner shell to create a gap between said side edges.

6. A carton as defined in claim 5 wherein each of said openings is of generally triangular shape, one corner of the opening extending between the side edges of adjacent side wall panels of the inner shell.

7. A carton as defined in claim 1 wherein the side edges of two adjacent side wall panels of said inner shell are unconnected, one of said unconnected panels being reduced in width as compared to the comparable panel at the opposite side of the carton.

* * * * *